US005392822A

United States Patent [19]

Kraus

[11] Patent Number: 5,392,822

[45] Date of Patent: Feb. 28, 1995

[54] BAND TIGHTENING APPARATUS

[75] Inventor: Willibald Kraus, Grunstadt, Germany

[73] Assignee: TRW United Carr GmbH & Co. KG, Enkenbach-Alsenborn, Germany

[21] Appl. No.: 95,274

[22] Filed: Jul. 21, 1993

[30] Foreign Application Priority Data

Jul. 27, 1992 [DE] Germany ..... 4224826

[51] Int. Cl.[6] ..... B21F 9/02

[52] U.S. Cl. ..... 140/123.6; 140/93.2

[58] Field of Search ..... 140/93.2, 123.6

[56] References Cited

U.S. PATENT DOCUMENTS 3,830,263 8/1974 Benfer ..... 140/123.6
3,853,155 12/1974 Kabel ..... 140/123.6
4,093,005 6/1978 Eberhardt et al. ..... 140/93.2

*Primary Examiner*—Lowell A. Larson

*Attorney, Agent, or Firm*—Fay, Sharpe, Beall, Fagan, Minnich & McKee

[57] ABSTRACT

An apparatus for the tightening of at least one profiled band element 3 looped around at least one tube-shaped body 2. The band element having a head piece 4 which carries within a passage aperture 5 a resilient locking element which interacts with the profiled portion of the band element. The apparatus includes a spring-loaded band gripper 7 which is rotatable around a fulcrum 8. The gripper 7 is arranged on a spring-loaded sliding carriage 9 inside a housing 10. Moreover, there is provided a cutting lever 11 that is rotatable around a housing-fixed fulcrum 12 and carrying a knife 13 in the area of the band gripper. A trigger lever 14 is rotatable around a housing-fixed fulcrum 15. By means of the trigger lever, the sliding carriage 9 and the cutting lever 11 can be activated. The trigger lever 14 supports itself via a rotatable in sliding carriage 9. Thus, the cutting lever 11 is activatable via the rotatable curve element 16 and is actuated to cut the band only after release of the tensioning forces on the band.

11 Claims, 1 Drawing Sheet

BAND TIGHTENING APPARATUS

BACKGROUND OF THE INVENTION

The subject invention pertains to a device for the tightening of at least one profiled band element or strap looped around at least one tube-shaped body and having a head piece which carries within a passage aperture a resilient locking element that interacts and engages with the profiled portion of the band or strap element.

Devices of this general type are already known according to the state of the art. Generally they are equipped with a spring-loaded band carrier that is arranged to be rotatable around a fulcrum in a spring-loaded sliding carriage within a housing. Furthermore, it is known to use a cutting lever, rotatable around a housing-fixed fulcrum and carrying a knife in the area of the band carrier. In addition, in these prior devices, there is provided a triggering lever rotatable around a housing-fixed fulcrum with a sliding carriage and cutting lever being activatable by means triggering lever.

The purpose of this known device is to tighten a profiled band element looped around at least one tube-shaped body in such manner that excellent holding support results. If this tight holding support is accomplished, the projecting area of the profiled tape element is cut off via the knife which is frontally attached to the cutting lever.

The disadvantage with known prior art constructions of this type is that the cutting-off of the projecting profiled tape element is done under tension so that the plastic material of which the profiled band element is generally made can spring back. Thus, there is no longer assurance of satisfactory and tight holding support of the tube-shaped body about which the band is looped. In addition, during the cutting process, the profiled tape element may be pulled out of the resilient locking element because of the tension. Thus, in actual practice, the cutting-off of the projecting tape element under tension presents significant drawbacks. Thus, it is the objective of the present invention to create a device which guarantees in simple fashion that the cutting-off of the projecting band element takes place in a relaxed state.

BRIEF DESCRIPTION OF THE INVENTION

According to the subject invention, the above-discussed task is solved in that the triggering lever supports itself via a rotatable curve element against a spring-loaded tripping lever that is rotatably positioned in a carriage and the cutting lever is activatable via the rotatable curve element. This affords the advantage that the following sequence of process steps take place with the aid of the device according to the invention: a) tensioning of the band-shaped element until firm placement against at least one tube-shaped body; b) relaxing of the band element; and, c) cutting off of the projecting band element. This results in beneficial avoidance of undesired recoil during the cutting-off and also in secure placement of the profiled portion of the band element within its head piece.

In a further feature of the invention, the rotatable curve element can be designed as an ejection lever positioned in a fulcrum of the triggering lever which exhibits at a free end at least one supporting roller to act as a brace support. The supporting roller may be positioned against the action of a spring in a counter profile of the tripping lever to be pushed out upon activation of the triggering lever. This will ensure that upon completion of the tensioning there momentarily sets in a relaxation process, at the end of which the cutting process is performed.

In further refinement of the invention, the spring may be designed as a tension spring and can be attached on one side to the tripping lever and on the other side to the sliding carriage. In order to achieve an adjustment of the tractive effort or pulling force, the tension spring may be adjustable, for example, it may be connected via a guidance carriage at the sliding carriage. The guidance carriage is connected to an adjustment screw positioned rotatably in the sliding carriage. With the aid of this screw, the tension of the tension spring can be adjusted in a simple fashion, which, in turn, transfers to the tripping lever.

According to another characteristic of the invention, in the area of the free end of the ejection lever, the sliding carriage may exhibit a curve guidance for the disengagement of the ejection lever by which the ejection lever stresses the cutting lever. The supporting roller which is guided by the curve guidance of the sliding carriage can stress or load the cutting lever at the top against the action of a spring. Thus, immediately following the relaxation process, the protruding end of the band element is cut off.

In order to draw the band element into the apparatus without damage to the band element, the spring-loaded band carrier may exhibit central zone adapted to the profile of the transverse section of the profiled band element, as well as lateral smooth supporting areas. This will ensure that the longitudinally spaced cross pieces of the profiled band element will not come into the influence region of the band carrier.

In order to improve the "draw-in" effect with the aid of the band carrier, there may be a housing mounted plate arranged beneath the band element. The distance between the bracing zones and the plate may be smaller than the diameter of the respective cross pieces of the profiled tape element. The housing-fixed plate may be dome-shaped at the top. These features produce a clamping type grip on the band or tape element along the heavier side pieces.

BRIEF DESCRIPTION OF THE DRAWINGS

The above and other objects and advantages of the invention will become apparent from the following description when read in conjunction with the accompanying drawings wherein.

DETAILED DESCRIPTION OF THE PREFERRED EMBODIMENT

Figure 1:
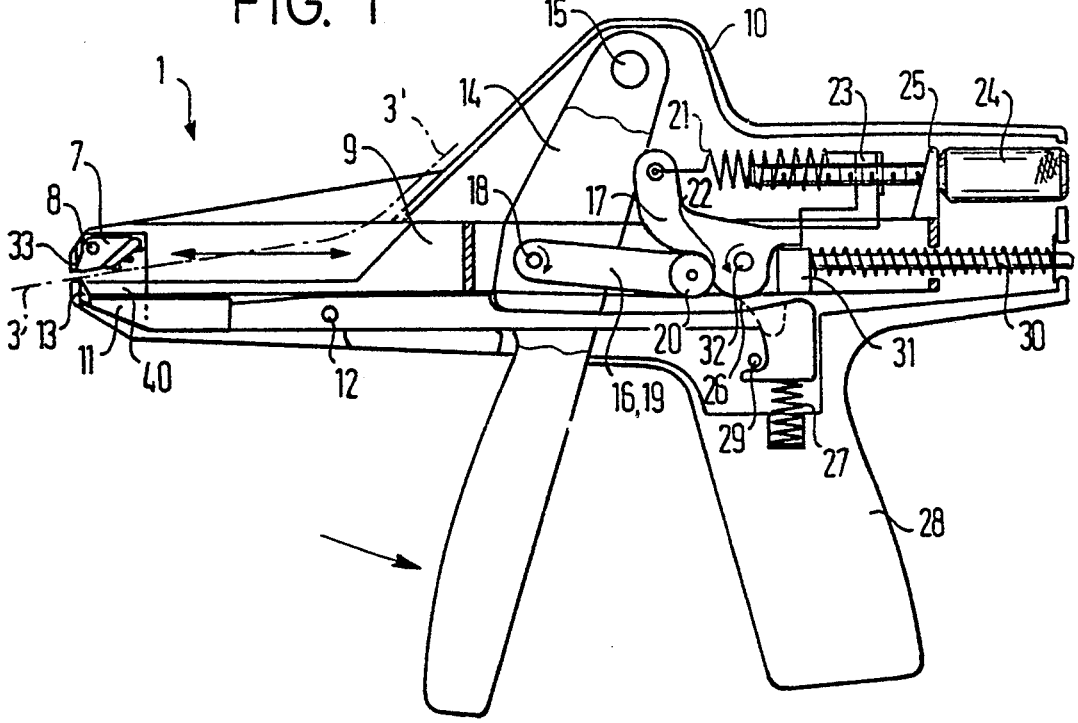
FIG. 1 is a schematic side view of the apparatus according to the invention.
Figure 3:
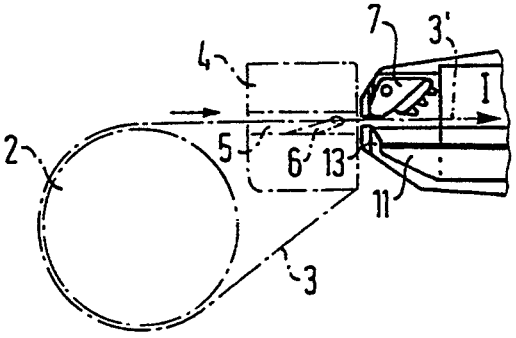

Referring more particularly to the drawings wherein the showings are for the purpose of illustrating a preferred embodiment of the invention only, and not for the purpose of limiting same, and as best seen in FIGS. 1 and 3, the apparatus 1 according to the invention serves for tightening of at least one band element 3 which is looped around at least one tube-shaped body 2. In this arrangement the band element 3 is of conventional form and includes a head piece 4 that carries within a passage aperture 5 a resilient tab-like locking element 6. Element 6 interacts with the profiled band element 3 that carries openings or teeth that are engaged by element 6 in a known manner. By placement of the head piece 4 against the frontal side of the apparatus 1 according to the invention and through pulling or movement of the profiled band element 3 in the direction of the arrow 1, there occurs a tensioning of the profiled band element 3 about body 2.

According to FIG. 1, apparatus 1 includes a band carrier or gripper 7 which is arranged in the outlet zone. The band carrier 7 is arranged rotatably around a fulcrum pin 8 in an elongated sliding carriage 9. The carrier 7 includes means for gripping and holding the band during the tensioning step.

Figure 2:
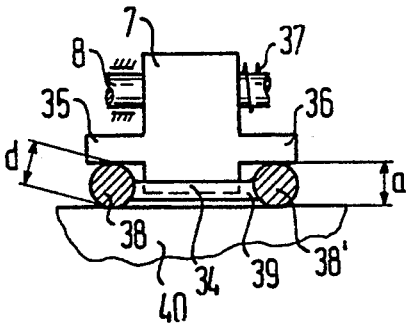
FIG. 2 is a front view of the band carrier showing longitudinal cross pieces of the profiled band element; and, FIG. 3 shows the anterior region of the apparatus to the invention with the band element shown in phantom.

As shown in FIG. 2, the band carrier 7 is stressed by a torsion spring 37 such that, in the position illustrated in FIG. 1, the torsion spring causes the band carrier 8 to be biased in a clockwise direction to abut a lug 33 in the outlet zone of apparatus 1.

The sliding carriage 9 is positioned and guided within a housing 10 and is stressed from the rear by a compression spring 30 which acts on the one side against housing 10 and on the other side receives support in the area of a mechanism 31 of the sliding carriage 9. Because of spring 30, the sliding carriage 9 is pressed together with band carrier 7 against the outlet zone of apparatus 1.

Below the sliding carriage 9 in housing 10 there is arranged a cutting lever 11 that is rotatable around a fixed fulcrum pin 12 mounted in housing 10. At its front or left end as viewed in FIG. 1, the cutting lever carries a transversely mounted knife 13 opposite lug 33 in the area of the band carrier 17. On the other side of the cutting lever 11, a compression spring 27 stresses the cutting lever's free or right end in a counterclockwise direction as viewed in FIG. 1. A fixed position lug or stop 29 limits the clockwise movement of lever 11.

Within housing 10 there is a manually actuatable trigger lever 14 which is rotatable around a fixed fulcrum shaft 15. The trigger lever 14 carries a fulcrum pin 18 at which is arranged a rotatable curve element 16 in the form of an elongated ejection lever 19. The fulcrum pin 18 also serves to connect the sliding carriage 9 with the trigger lever 14.

At the right or free end of the ejection lever 19 (as seen in FIG. 1), there is arranged at least one support roller 20. The roller 20 is positioned to engage within a counter profile 22 of an ejection lever 17. The ejection lever 17 is positioned on a fulcrum pin 32 in the sliding carriage 9 and has a free arm which extends upward. The force of a tension spring 21 is applied to the upper end of the free arm. The tension spring 21 connects to a guidance carriage 23 that is slidably positioned in suitable guides in sliding carriage 9. The sliding carriage 23 works in concert with a threaded stem of an adjustment screw 24 that is turnable within a bearing 25 of sliding carriage 9.

If the adjustment screw 24, for example, a knurled head screw, is turned, then the sliding carriage 23 is displaced via the interacting threads. Thus, the tension spring 21 can be adjusted to greater or lesser tension. In this way, the contact pressure of counter profile 22 against supporting roller 20 can be regulated to regulate the tension force to be applied prior to cutting.

Sliding carriage 9 has a curved guidance portion at the bottom in the area of the supporting roller 20. The curve guidance 26 is designed such that the supporting roller 20 of the ejection lever 19 can slide on it and is conducted down to engage the top side of the cutting lever 11 to produce a cutting operation.

Housing 10 also carries a pistol grip type handle 28 opposite trigger lever 14 to allow ready actuation of lever 14.

The operation of the apparatus of the invention will now be described. Initially, the anterior end of band element 3 is inserted into the aperture 5, according to FIG. 3. That is to say, it is inserted until, according to FIG. 2, the cross profile 39 of band element 3 is positioned in the profile area 34 of band carrier 7. The band carrier 7 exhibits on both sides of the profile area 34, two bracing zones 35 and 36, which compress and clamp, under the effect of spring 37, the longitudinal cross pieces 38 and 38' of band element 3.

Beneath band carrier 7 there is located a plate 40 which may be designed, for example, to be slightly arched. In this configuration, distance "a" of the bracing zones 35 and 36 to plate 40 is preferably smaller than diameter "d" of the longitudinal pieces 38 and 38' of band element 3.

After the profile zone 34 of band carrier 7 has positioned itself into the corresponding cross profiles 39 of band element 3, the trigger lever 14 is moved in the direction of the arrow toward handle 28. As a result, the band carrier 7 swings, against the effect of torsion spring 37, clockwise, that is to say until such point in time when the band carrier 7 exits from the contact zone of cross profile 39 of band element 3. Concurrently with the aforementioned movement, the sliding carriage 9 moves to the right due to fulcrum 18. If the sliding movement of the sliding carriage 9 to the right against the effect of spring 30 is completed, the trigger lever 14 is released. It then swings clockwise around its fulcrum 15 until the band carrier 7 is again positioned against lug 33 and once more engages with its profile 39 the transverse profile 38 of band element 3. The aforementioned step can be repeated so that by and by the band element 3, with the aid of the movement of the trigger element 14, is displaced to the right and loops increasingly tighter around the tube-shaped body 2.

When the process of tensioning the band element is completed, the head piece 4 rests firmly in the area of the aperture of apparatus 1 pursuant to the invention. If trigger lever 14 is then nevertheless continuously turned clockwise around fulcrum 15, roller 20 of the disengagement lever 19 slides out of the counter profile 22 of the tripping lever 17 so that the sliding carriage 9, for a brief moment, under the action of spring 30, moves from right to left and that thus the tensioning process is now followed by a brief relaxation process of band element 3.

During the continuation of the rotary movement of trigger lever 14 around fulcrum 15, the support roller 20 slides along curve guidance 26 of sliding carriage 9 downward and actuates cutting lever 11 which is rotated clockwise around fulcrum 12.

As a result of this rotation, knife 13 goes into action in the anterior area of the cutting lever 11 and severs band element 3, which is momentarily in relaxed state, so that the process of tensioning, relaxing, and cutting is thus completed.

The aforementioned sequences relative to relaxation and cutting occur within a very brief time period. However, in each instance, as a result of the design of the support roller 20 and the counter profile 22, as well as curve guidance 26, there is assurance that cutting of the protruding band portion 3', according to FIG. 3, will only occur in relaxed state.

Through adjustment of knurled-head screw 24, the tension spring 21 can be adjusted correspondingly, so that in simple fashion there is ensured adjustment of the pulling force. In other words, it is possible to regulate the contact pressure of support roller 20 in the counter profile 22 of the tripping lever 17 which is rotatable around fulcrum 32.

As a result of the specific design of apparatus 1 pursuant to the invention, there is achieved significant improvement in the automatic, manual tightening with the aid of a band element.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. In an apparatus for tightening a profiled band element looped around at least one tube-shaped body in its associated head piece which exhibits within a passage aperture a resilient locking element which interacts with the profiled bank element, the apparatus including a spring-loaded band gripper that is carried by a sliding carriage within a housing, and further including a cutting lever rotatable around a fixed fulcrum to cut the portion of the band element extending beyond the head piece and a trigger lever by means of which the sliding carriage is moved to tension the band element in the head piece, the improvement wherein release means are provided for releasing the tension on the band element immediately prior to actuating the cutting lever to cut the portion of the band element extending beyond the head piece, the release means including a rotatable curve element (16) acting against a spring-loaded tripping lever (17) carried by the sliding carriage, the rotatable curve element comprising a pivotal disengagement lever (19) having a free end that actuates the cutting lever (11) after release from the tripping lever (17).

2. The apparatus according to claim 1 wherein the free end of the pivotal disengagement lever includes a support roller (20) that acts against the action of a spring (21) in a counter profile (22) of the tripping lever (17) and can be pushed out of same upon activation of the trigger lever (14).

3. The apparatus according to claim 2 wherein the spring (21) is a tension spring and is attached on the one side to the tripping lever (17) and on the other side to the sliding carriage (9).

4. The apparatus according to claim 3 wherein the tension spring (21) is adjustable.

5. The apparatus according to claim 4 wherein the tension spring (21) is positioned via a guidance carriage (23) at the sliding carriage (9) and the guidance carriage (23) is connected with an adjustment screw (24) which is rotatably arranged at the sliding carriage (9).

6. The apparatus according to claim 5 wherein the sliding carriage (9) exhibits in the area of the free end of the disengagement lever (19) for the disengagement of same, a curve guidance (26), via which the disengagement lever (19) stresses the cutting lever (11).

7. The apparatus according to claim 6 wherein the support roller (20) is guided by the curve guidance (26) of the sliding carriage (9) and the cutting lever (11) is biased by a spring (27) and rotatable around a fixed fulcrum (12).

8. The apparatus according to claim 1 wherein the spring-loaded band gripper (7) is positioned against a fixed lug (33) and carries a profile zone (34) and smooth support zones (35, 36).

9. The apparatus according to claim 8 wherein beneath band gripper (7) there is arranged a fixed plate (40) and wherein the distance (a) between the support zones (35, 36) and the plate (40) is smaller than the diameter (d) of the respective longitudinal cross pieces (38, 38') of the profiled band element (3).

10. The apparatus according to claim 9 wherein the fixed plate (40) is concave at the top.

11. In an apparatus for tightening a profiled band element looped around at last one tube-shaped body in its associated head piece which exhibits within a passage aperture a resilient locking element that interacts with the profiled band element, the apparatus including a spring-loaded band gripper that is carried by a sliding carriage within a housing, and further including a cutting lever rotatable around a fixed fulcrum to cut the portion of the band element extending beyond the head piece and a trigger lever by means of which the sliding carriage is moved to tension the band element in the head piece, the improvement wherein release means are provided for releasing the tension on the band element immediately prior to actuating the cutting lever to cut the portion of the band element extending beyond the head piece, the release means including a rotatable curve element (16) acting against a spring-loaded tripping lever (17) positioned rotatably in a sliding carriage (9) with the cutting lever (11) actuatable via the rotatable curve element, the rotatable curve element (16) comprising a disengagement lever (19) pivotable about a fulcrum (18) of the trigger lever (14) and having a free end carrying at least one support roller (20).

* * * * *